US005476329A

United States Patent [19]

Park

[11] Patent Number: 5,476,329

[45] Date of Patent: Dec. 19, 1995

[54] PRINTING METHOD AND APPARATUS FOR THERMAL TRANSFER PRINTER

[75] Inventor: Moon-bae Park, Suwon, Rep. of Korea

[73] Assignee: Samsung Electronics Co., Ltd., Kyungki-Do, Rep. of Korea

[21] Appl. No.: 312,660

[22] Filed: Sep. 27, 1994

[30] Foreign Application Priority Data

Sep. 28, 1993 [KR] Rep. of Korea ..... 1993-20337

[51] Int. Cl.[6] ..... B41J 2/32; B41J 35/18

[52] U.S. Cl. ..... 400/120.02; 400/120.04

[58] Field of Search ..... 400/120.02, 120.04, 400/120 MP; 346/76 PH

[56] References Cited

U.S. PATENT DOCUMENTS 4,388,628 6/1983 Moriguchi ..... 400/120.02

4,703,346 10/1987 Bierhoff ..... 400/120.02

*Primary Examiner*—Edgar S. Burr

*Assistant Examiner*—Steven S. Kelley

*Attorney, Agent, or Firm*—Sughrue, Mion, Zinn, Macpeak & Seas

[57] ABSTRACT

A printing method and apparatus wherein the circumference of a drum is shorter than the length of paper so that the paper is wound around the drum with the top and bottom ends of the paper overlapping by a predetermined length. Printing begins at a position spaced apart from the leading edge of the paper by the difference between the circumference of the drum and the length of the paper. An ink ribbon contains colorless portions, whose lengths are equal to the predetermined length, which is equal to the difference between the circumference of the drum length of the paper, at the borders of respective portions. Respective colors are serially printed when a printing head presses the ink ribbon. When the printing head presses the overlapping portion of bottom ends of the paper, the colorless portion of the ink ribbon passes the printing head.

6 Claims, 4 Drawing Sheets

PRINTING METHOD AND APPARATUS FOR THERMAL TRANSFER PRINTER

BACKGROUND OF THE INVENTION

1. Field of the Invention

The present invention relates to a printing method and apparatus for a printer, and more particularly, to a printing method and apparatus for a thermal transfer printer, or the like, which prints without raising a printing and reduces the size of top and bottom-margins of a sheet of paper when printing color images.

2. Description of the Related Art

Generally speaking, a thermal transfer printer has a thermal printing head with a heating element, and a film-shaped ribbon coated with ink. The ribbon is placed between paper and the thermal printing head and ink in the ribbon is sublimed in a predetermined pattern onto a sheet of paper through heat and pressure. In order to obtain full color printing, a color thermal transfer printer performs printing three times in color-separated yellow, magenta and cyan, respectively.

FIG. 1 illustrates a conventional color ink ribbon employed in the conventional printing method and apparatus for a thermal transfer printer. FIG. 2 illustrates a conventional printer using the ribbon of FIG. 1. The printer of FIG. 2 is a platen type in which a sheet of paper is delivered in close contact with a drum and guide rollers. Referring to FIG. 2, a plurality of guide rollers 5, 5', 6 and 6' are in contact with the circumference of a drum 4. A paper feeding cassette 9 is provided at a predetermined position under drum 4. Paper 3 is supplied to drum 4 by a paper feeding cam 7.

Ink ribbon 1 of FIG. 1 on which yellow (Y), magenta (M), and cyan (C) portions are provided serially as stripes extending across the width of the ink ribbons, is placed between printing head 2 and paper 3 and is wound in one direction by a driving means (not shown). Printing head 2 is movable up and down as shown in FIG. 2, to press or release ink ribbon 1.

According to the printing method of the conventional thermal transfer printer constructed as above, paper 3 is fed to drum 4 by paper feeding cam 7. Paper 3 having reached the drum is conveyed in close contact with guide rollers 5 and 5' and drum 4. When the leading edge of conveyed paper 3 reaches guide roller 6 located beyond an initial printing position, drum 4 stops.

Then ink ribbon 1 is transported according to a printing signal. One of the three portions (Y, M and C), the leading edge of portion Y is placed to coincide with the initial printing position of paper 3. Subsequently, printing head 2 is lowered to thermally press (i.e., press and heat) ink ribbon 1 and paper 3, and simultaneously drum 4 rotates one revolution. This is the printing process for transferring a yellow image onto paper 3.

Next, printing head 2 is lifted, and the leading edge of portion M of ink ribbon 1 is set to coincide with the initial printing position of paper 3. Printing head 2 is lowered again and ink ribbon 1 and paper 3 are thermally pressed and drum 4 rotates one revolution, thereby printing a magenta image onto the paper to be superimposed on the yellow image. The printing of the third color, cyan, is carried out in the same manner as above.

Such a conventional printing method, however, has a problem in that the printing time is undesirably lengthened since printing head 2 must be raised whenever ink ribbon 1 is transported to position a specific color portion in opposition to print head 2.

Further, in the conventional printing method, since printing is initialized when the leading edge of paper 3 advances to guide roller 6 as shown in FIG. 2, to prevent paper 3 from separating from drum 4 due to the compression force of printing head 2 and the rotation of drum 4 during printing, the top margin of paper 3 is undesirably maintained as an interval a between printing head 2 and guide roller 6, with the bottom margin of paper 3 kept as a symmetrical interval a'.

SUMMARY OF THE INVENTION

Therefore, in order to overcome such problems, it is a first object of the present invention to provide a printing method and apparatus for a thermal transfer printer in which printing is continuously performed without the need to raise a printing head.

It is a second object of the present invention to provide a printing method and apparatus in which printing is performed by reducing the size of top and bottom margins of a sheet of paper.

To accomplish the objects of the present invention, there is provided a printing method of a thermal transfer printer for feeding a sheet of paper to a rotating drum, conveying the paper sheet in close contact with the drum, and thermally pressing a multicolored ink ribbon with a printing head to print a color image. The method includes the steps of: feeding the paper sheet so that the paper sheet is wound around the drum with the top and bottom ends of the paper sheet overlapping by a predetermined length; printing at a position spaced apart from the leading edge of the paper sheet by the predetermined length; and changing color portions of the ink ribbon with the paper sheet and ink ribbon pressed by the printing head. The ink ribbon contains colorless portions, whose respective lengths are equal to the predetermined length, between respective color portions.

The invention also is a printing apparatus for a thermal transfer printer having a drum for conveying paper, a color ink ribbon on which a plurality of color portions are sheet-sequentially formed, and a printing head for thermally pressing the ink ribbon and thereby printing a color image on the paper. The circumference of the drum is shorter than the length of the paper so that the top and bottom ends of the paper overlap by a predetermined length, and the ink ribbon contains colorless portions whose lengths are equal to the predetermined length between the respective color portions of the ink ribbon.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE PREFERRED EMBODIMENT

Figure 1:
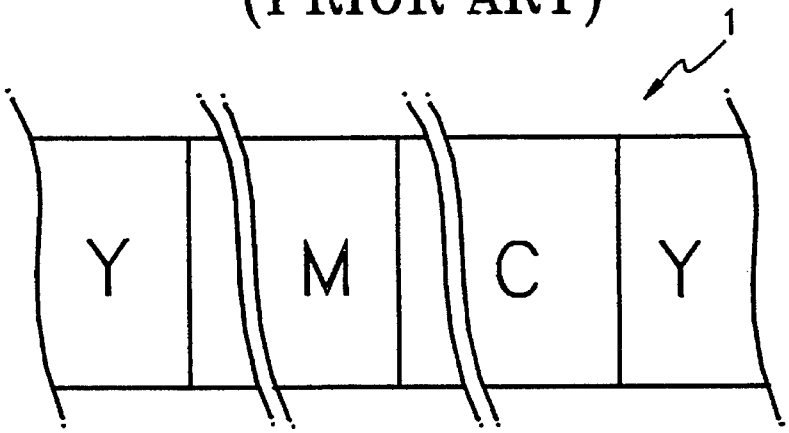
FIG .1 (PRIOR ART)
FIG. 1 illustrates a conventional ink ribbon.
Figure 2:
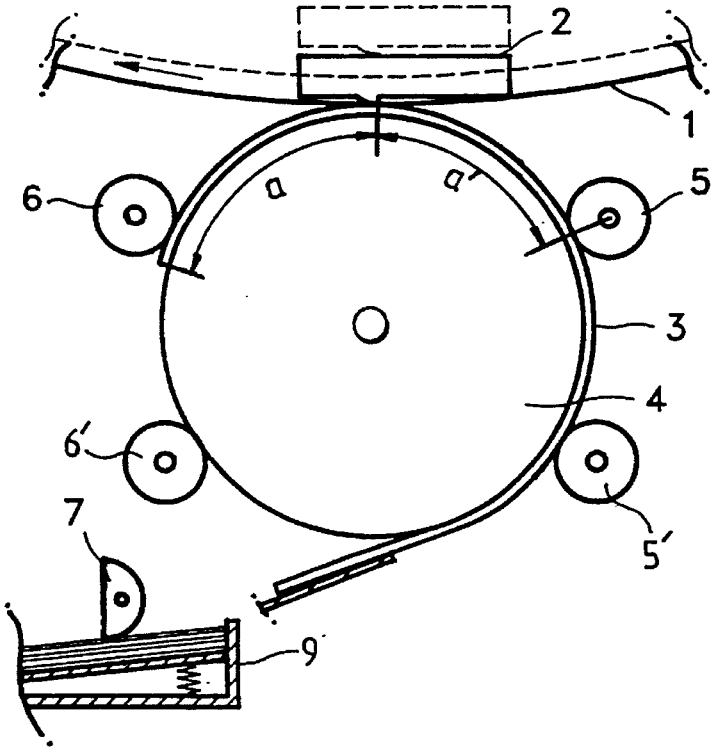
FIG .2 (PRIOR ART)
FIG. 2 illustrates a conventional printer for explaining a conventional printing method.
Figure 3:
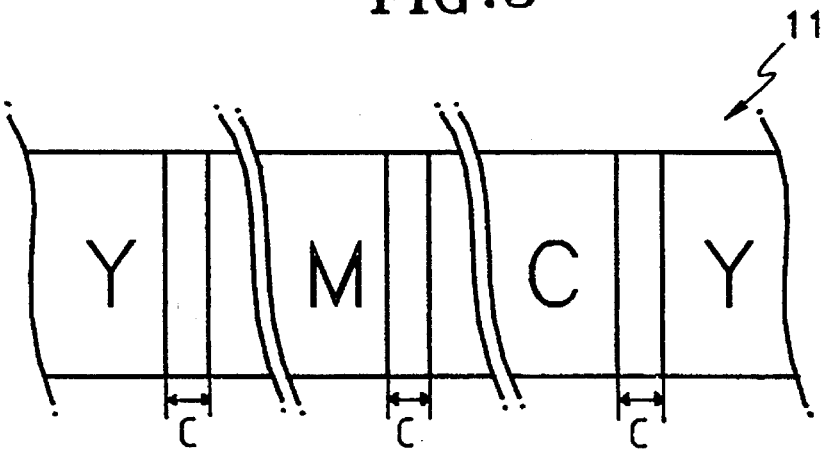
FIG. 3 is a schematic illustration of an ink ribbon applied to a printing apparatus of the preferred embodiment of the present invention.

Referring to FIGS. 3, 4, 5 and 6, the printing method of the preferred embodiment of the present invention will be explained, for example, with a platen-type printer in which one sheet of paper 13 is conveyed in close contact with guide rollers 15, 15', 25 and 25' and a drum 14. In the printing method for a thermal transfer printer of the preferred embodiment, the circumference of drum 14 is designed to be shorter than the length of paper 13. Paper 13 is thus wound therearound with its top and bottom ends being superposed by a predetermined length d' (see FIG. 6). Paper 13 is delivered to drum 14 from a paper feeding cassette 19 by a paper feeding cam 17 (see FIG. 4) .

Printing begins at a position where the leading edge of paper 13 passes a printing head 12 by the superposed length d'. Ink ribbon 11 has colorless sections, (i.e, sections containing no ink) of a width c which is equal to the superposed length d'. The colorless sections are provided between respective color portions. A width of a color portion and a respective colorless section combined is equal to the circumference of drum 14. Printing of the respective colors is continuously performed while printing head 12 presses ink ribbon 11. Printing head 12 presses colorless section C against the superposed portion of the top and bottom ends of paper 13.

Figure 4:
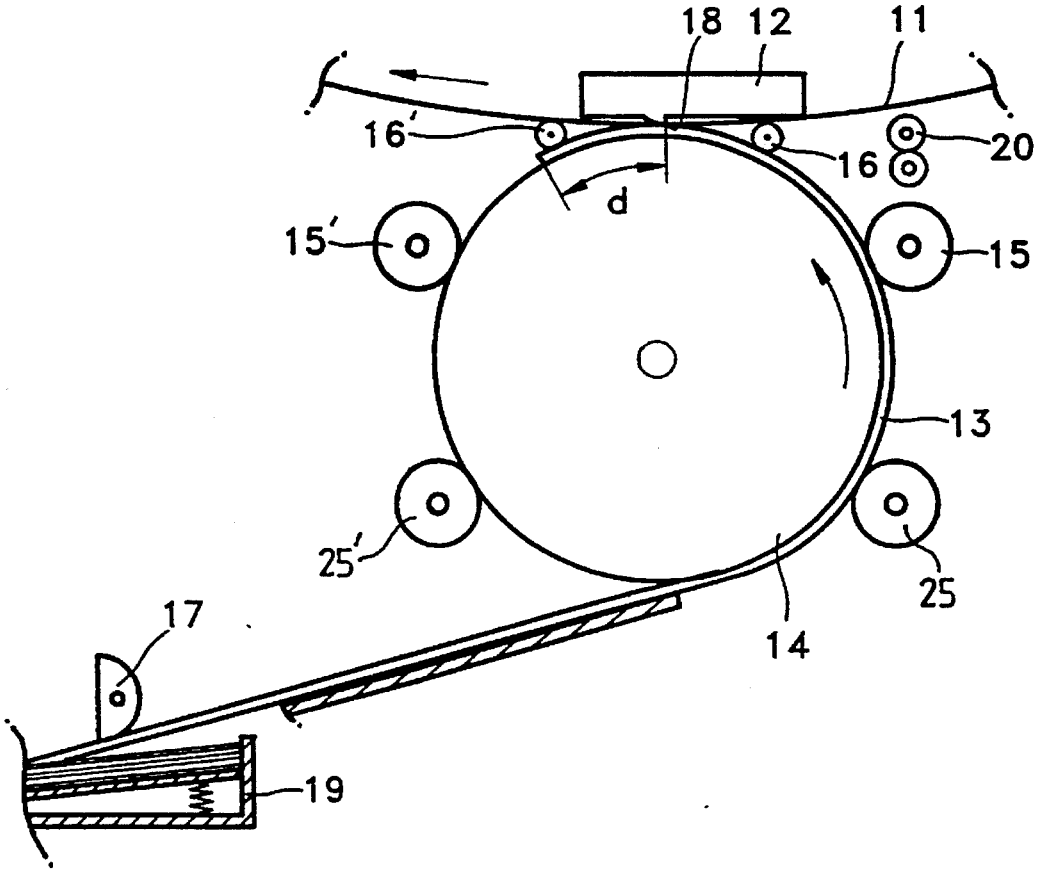
FIGS. 4, 5 and 6 illustrate the operation of the printing apparatus of the preferred embodiment.

More specifically, paper 13 is first conveyed from paper feeding cassette 19 to drum 14 by paper feeding cam 17. As shown in FIG. 4, when the leading edge of paper 13 is transported by a distance, which is equal to the difference between the circumference of drum 14 and the length of one sheet of paper 13, beyond an initial printing position 18, drum 14 stops rotating. Then, ink ribbon 11 is shifted in response to a signal from a controller so that portion Y thereof is located above the initial printing position. Printing head 12 is then lowered to thermally press ink ribbon 11 and to perform yellow printing based on a printing signal which represents the image to be printed.

Figure 6:
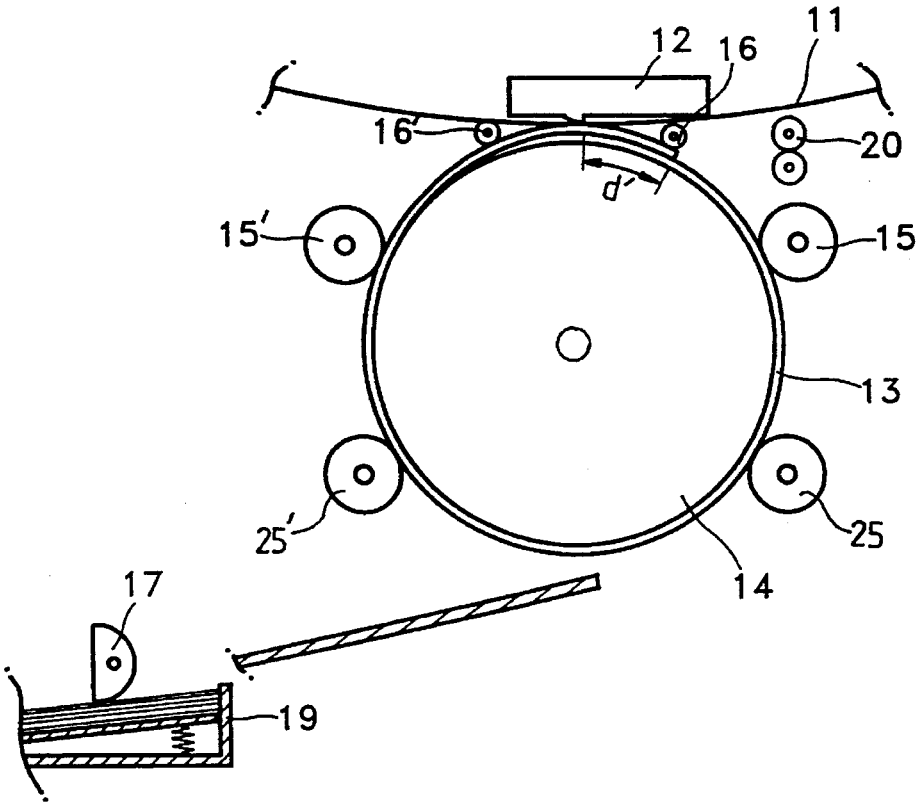

When drum 14 rotates through one revolution, paper 13 is completely wound around drum 14. As shown in FIG. 6, the top and bottom ends of paper 13 overlap with each other by the difference between the circumference of drum 14 and the length of one sheet of paper 13. Therefore, printing is not performed for a length d or d', i.e. the difference between the circumference of drum 14 and the length of paper 13.

After drum 14 rotates one revolution for yellow printing, printing head 12 continues to press ink ribbon 11. At this time, the colorless portion c between the Y and M portions of ribbon 11 corresponds to the length d' where the top and bottom ends of paper 13 overlap. As ink ribbon 11 is wound and the leading edge of portion M is located apart from the leading edge of paper 13 by length d, a magenta image is printed according to the printing signal. Cyan is printed in the same manner.

The printing method of the preferred embodiment described above has the following advantages:

First, since a sheet of paper is conveyed with its top and bottom ends overlapping, the leading edge of the sheet of paper does not become separated from the drum when the paper is conveyed to the printing position. This enables the paper to be stably delivered to the printing position. Second, the printing head is not required to be raised to find a specific color portion of the ink ribbon according to the printing signal. Thus, printing time is reduced.

Hereinafter, a printing apparatus of the preferred embodiment suitable to employ the above method will be described.

Figure 5:
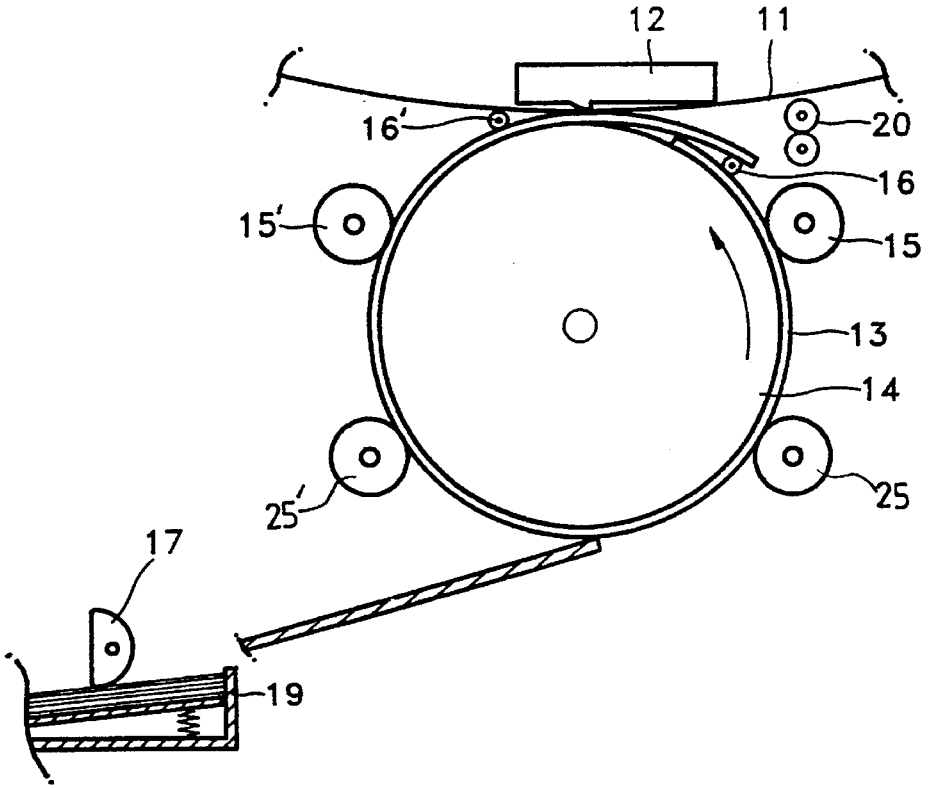

Referring to FIGS. 4, 5 and 6, a plurality of guide rollers 15, 15' 25 and 25' are in elastic contact with the circumference of drum 14 which is rotatively driven by a motor (not shown). Paper feeding cassette 19 is placed at a predetermined position under drum 14. Printing head 12 is installed above drum 14 and can be raised/lowered by a driving means (not shown). Ink ribbon 11 is provided between printing head 12 and drum 14 and is wound at a predetermined speed by a drive device (also not shown).

As the characteristic structure of the present invention, the circumference of drum 14 is made to be shorter than the length of paper 13 so that the top and bottom ends of paper 13 overlap by length d' when paper 13 is wound around drum 14. In ink ribbon 11 having yellow (Y), magenta (M) and cyan (C) portions in series, colorless portions of width c, which is the same as length d' where the top and bottom ends of paper 13 overlap, are provided between each successive color portion Between guide rollers 15 and 15' before and after initial printing position 18, are placed auxiliary guide rollers 16 and 16' so that paper 13 is stably conveyed without the top or bottom end thereof becoming separated from drum 14.

Here, length d' where the top and bottom ends of paper 13 overlap each other, width c of each colorless portion between the respective color portions of ink ribbon 11, and the width between auxiliary guide roller 16 or 16' and initial printing position 18 are all substantially the same.

The operation of the thermal transfer printer of the preferred embodiment will be described below.

First, paper 13 is supplied to drum 14 from paper feeding cassette 19 by the driving of paper feeding cam 17. Supplied paper 13 is carried in contact with guide rollers 15, 15' 25 and 25' and drum 14 When the leading edge of paper 13 travels by distance d beyond initial printing position 18 under the power of a stepping motor (not shown) for driving drum 14, the conveyance of paper 13 stops. Here, the leading edge of paper 13 is held down by auxiliary guide roller 16'. As ink ribbon 11 is conveyed according to the printing signal and the leading edge of portion Y is located at initial printing position 18, printing head 12 thermally presses the ink ribbon and thereby begins printing as drum 14 rotates.

When drum 14 rotates one revolution to finish printing yellow, printing head 12 presses ink ribbon 1 at a portion away from the bottom end of paper by length d' as shown in FIG. 6 The bottom end of paper 13 is held down by auxiliary guide roller 16.

Figure 7:
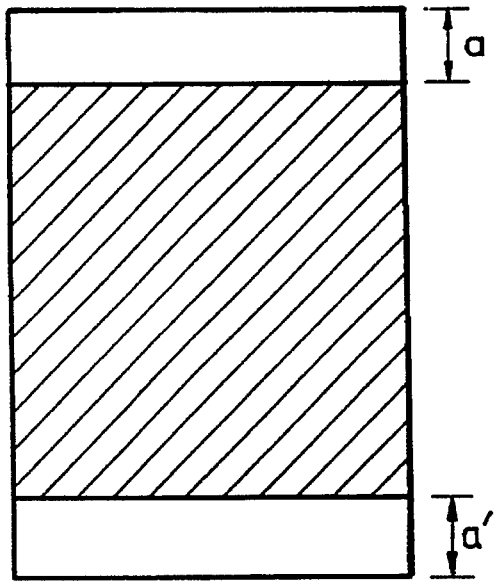
FIG .7 (PRIOR ART)
FIG. 7 illustrates the top and bottom margins of a sheet of paper according to the conventional printing method carried out by the printing apparatus shown in FIG.2.
Figure 8:
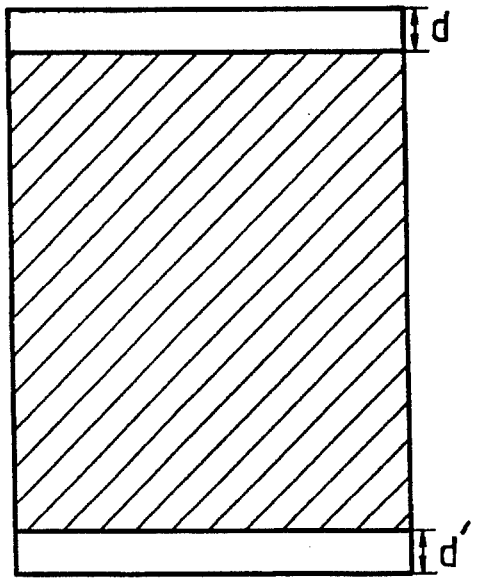
FIG. 8 illustrates the top and bottom margins of a sheet of paper according to the printing method of the present invention.

Subsequently, in printing magenta, in a state when printing head 12 presses ink ribbon 11, the ink ribbon and paper are conveyed together while the colorless portion c of ink ribbon 11 coincides with length d' of the bottom end of paper 13. When the leading edge of portion M is located at a position spaced from the leading edge of paper 13 by length d, printing begins according to the printing signal. In this state, when printing head 12 thermally presses the ink ribbon and performs printing as in the above process to finish printing, an image is printed with margins of length d or d' appearing at the top and bottom ends respectively of paper 13, as shown in FIG. 8. These margins are narrower than those of FIG. 7 printed by the conventional printer.

Meanwhile, the thermal transfer printer of the present invention discharges paper 13 via a paper discharging roller 20 by reversely rotating drum 14.

As described above, the printing method and apparatus of the thermal transfer printer of the present invention has certain distinct advantages.

First, since a drum with its circumference shorter than the length of paper 13, and an ink ribbon containing colorless portions having a length equal to the difference of the circumference of the drum and the length of paper at borders of the respective color portions ire provided, the printing head is not required to be raised to find a specific color in the ink ribbon, thereby simplifying operation and shortening printing time. Second, additional auxiliary guide rollers are provided between the initial printing position and main guide rollers, thereby reducing the top and bottom margins of paper 13 as compared with the conventional apparatus.

Control of the preferred embodiment can be accomplished with a known controller programmed in a predetermined manner and known actuation devices. For example, a microprocessor based controller, motors, and solenoids, or the like, can be used. Also, the printing signal can be generated in a known manner through, for example, three color scanning techniques.

The invention has been described through preferred embodiments. However, various modifications can be made without departing from the scope of the invention as defined by the appended claims.

What is claimed is:

1. A method for feeding a sheet to a rotating drum, conveying the sheet in close contact with the drum, and printing from a multicolored ink ribbon having color portions with a printing head to print a color image, said method comprising the steps of:

providing a sheet having top and bottom ends and a length greater than the circumference of a drum by a predetermined length feeding the sheet so that the sheet is wound around said drum with the top and bottom ends of the sheet overlapping by said predetermined length;

printing at a position spaced apart from the top end of the sheet by said predetermined length;

providing an ink ribbon containing colorless portions, whose respective lengths are equal to said predetermined length, between successive ones of said color portions and changing color portions of said ink ribbon while the sheet and ink ribbon are pressed against said drum by said printing head.

2. A method as claimed in claim 1, wherein, said step of printing includes using a printing head to press the overlapping portion of the top and bottom ends of the sheet as said colorless portion of said ink ribbon passes under said printing head to avoid printing on the overlapping portion.

3. A printing apparatus comprising:

a drum for conveying a sheet;

a color ink ribbon on which a plurality of color portions are sequentially formed; and a printing head for thermally pressing the ink ribbon against the sheet and thereby printing a color image on the sheet, wherein the circumference of said drum is shorter than the length of the sheet so that the top and bottom ends of the sheet overlap by a predetermined length, and said ink ribbon contains colorless portions, whose lengths are equal to said predetermined length, between successive ones of said color portions of said ink ribbon.

4. A printing apparatus comprising:

a drum for conveying a sheet;

main guide rollers for pressing the sheet in close contact with said drum;

a color ink ribbon on which a plurality of color portions are sequentially formed, and a printing head for printing a color image on the sheet, wherein the circumference of said drum is shorter than the length of the sheet so that the top and bottom ends of the sheet overlap by a predetermined length, said ink ribbon contains colorless portions whose lengths are equal to said predetermined length, disposed between successive ones of said color portions of said ink ribbon, and auxiliary guide rollers are provided around said drum between said main guide rollers and said printing head.

5. A printing apparatus as claimed in claim 4, wherein said predetermined length is set to be the same as the distance between the position of said auxiliary guide rollers and said printing head.

6. A printing apparatus as claimed in claim 4, wherein said printing head is a thermal print head which presses and heats said ribbon during printing.

* * * * *